US011241632B2

(12) United States Patent
Gordt

(10) Patent No.: US 11,241,632 B2
(45) Date of Patent: Feb. 8, 2022

(54) AMUSEMENT RIDE, PARTICULARLY A ROLLER COASTER

(71) Applicant: Mack Rides GmbH & Co. KG, Waldkirch (DE)

(72) Inventor: Dennis Gordt, Emmendingen (DE)

(73) Assignee: Mack Rides GmbH & Co. KG, Waldkirch (DE)

( * ) Notice: Subject to any disclaimer, the term of this patent is extended or adjusted under 35 U.S.C. 154(b) by 360 days.

(21) Appl. No.: 16/345,526

(22) PCT Filed: Sep. 18, 2017

(86) PCT No.: PCT/EP2017/073523
§ 371 (c)(1),
(2) Date: Apr. 26, 2019

(87) PCT Pub. No.: WO2018/086789
PCT Pub. Date: May 17, 2018

(65) Prior Publication Data

US 2019/0308112 A1 Oct. 10, 2019

(30) Foreign Application Priority Data

Nov. 14, 2016 (DE) ..... 10 2016 121 799.9

(51) Int. Cl.
*A63G 7/00* (2006.01)
*A63G 25/00* (2006.01)

(52) U.S. Cl.
CPC ..... *A63G 7/00* (2013.01)

(58) Field of Classification Search
CPC ..... A63G 25/00; A63G 21/00; A63G 21/04; A63G 7/00
(Continued)

(56) References Cited

U.S. PATENT DOCUMENTS 4,531,459 A * 7/1985 Yamada ..... A63G 7/00 104/53
8,348,776 B2 * 1/2013 Crawford ..... A63G 31/02 472/43
(Continued)

FOREIGN PATENT DOCUMENTS

DE 3237684 4/1983
DE 10245147 4/2004
(Continued)

OTHER PUBLICATIONS

World Intellectual Property Organization, "International Search Report," and English translation thereof, issued in International Patent Application No. PCT/EP2017/073523, dated Dec. 6, 2017, document of 6 pages.
(Continued)

*Primary Examiner* — Kien T Nguyen
(74) *Attorney, Agent, or Firm* — Akerman LLP; Peter A. Chiabotti

(57) ABSTRACT

An amusement ride, particularly a roller coaster, comprising a guide track, a number of first vehicles that can move along said guide track and comprise a first person receiving arrangement, a number of second vehicles that can move along the guide track and comprise a second person receiving arrangement differing from said first person receiving arrangement, an in-coupling device, by means of which the first vehicles and/or the second vehicles can be coupled into the guide track, and a launch section by means of which said in-coupled first and second vehicles can be accelerated.

17 Claims, 2 Drawing Sheets

(58) Field of Classification Search
USPC ..... 472/43, 59, 60
See application file for complete search history.

(56) References Cited

U.S. PATENT DOCUMENTS

| | | | | |
|---|---|---|---|---|
| 8,490,550 | B2 * | 7/2013 | Crawford | A63G 7/00 104/63 |
| 8,864,592 | B2 * | 10/2014 | Baxter | A63G 1/10 472/31 |
| 2005/0061192 | A1 | 3/2005 | Roodenburg et al. | |
| 2015/0202536 | A1 | 7/2015 | Ortel | |
| 2016/0023121 | A1 | 1/2016 | McVeen et al. | |

FOREIGN PATENT DOCUMENTS

| | | |
|---|---|---|
| EP | 2298426 | 3/2011 |
| EP | 2854975 | 4/2015 |
| WO | 2007/050545 | 5/2007 |
| WO | 2016/014243 | 1/2016 |

OTHER PUBLICATIONS

German Patent Office, "Office Action," issued in German Patent Application No. 10 2018 121 799.9, dated Sep. 1, 2017, document of 4 pages.

* cited by examiner

AMUSEMENT RIDE, PARTICULARLY A ROLLER COASTER

CROSS REFERENCE TO RELATED APPLICATIONS

This application is a § 371 National Phase of PCT/EP2017/073523, filed Sep. 18, 2017, the entirety of which is incorporated by reference and which claims priority to German Patent Application No. 10 2016 121 799.9, filed Nov. 14, 2016.

FIELD OF APPLICATION

The present application relates to an amusement ride, particularly a roller coaster.

BACKGROUND

Amusement rides are a fixed component of fairs or amusement parks. Roller coaster rides comprising closed guide tracks with elevations, slopes, and loops through which a number of vehicles travel at sometimes very high speeds are particularly popular.

The attractiveness of amusement rides and particularly roller coasters depends, among other factors, on the type of surprising movements the vehicles can perform when traveling along the guide track. This element of surprise diminishes after an individual has been on this amusement ride multiple times. After a specific time in operation, the respective ride must be remodeled or a completely new amusement ride must be purchased to provide new surprising effects and maintain attraction. But this causes high investment costs, which are difficult to afford or cannot be afforded at all, particularly by smaller amusement parks, such that there is a risk that they cannot keep up with the economic power of bigger amusement parks.

SUMMARY

It is therefore the problem of one embodiment of the present disclosure to provide an amusement ride, particularly a roller coaster, which allows maintaining and/or increasing attraction over a longer period of operation at relatively low investment costs.

This problem is solved by the features and structures recited herein. Advantageous embodiments of the present disclosure are further disclosed herein.

One embodiment of the present disclosure relates to an amusement ride, particularly a roller coaster, comprising a guide track, a number of first vehicles that can move along said guide track and comprise a first person receiving arrangement, a number of second vehicles that can move along the guide track and comprise a second person receiving arrangement differing from said first person receiving arrangement, an in-coupling device by means of which the first vehicles and/or the second vehicles can be coupled into the guide track, and a launch section by means of which said in-coupled first and second vehicles can be accelerated.

A guide track of roller coasters defines a closed track section, such that the vehicles return to the starting point after a specific travel time. The vehicles comprise rolling devices which interact with the guide track such that the vehicles always stay connected to the guide track, even at high speeds, in narrow bends and loops. In addition, there are amusement rides that do not have a closed track section but instead have a U-shaped guide track, when viewed from the side, and in which the vehicles shuttle between the two legs of the guide track.

A person receiving arrangement is meant to include all components needed for positioning and securing individuals in the vehicle, such as seats and safety brackets.

An in-coupling device is intended to mean a device by means of which a vehicle can be removed from the guide track and added to the guide track again. In the simplest case, the in-coupling device can comprise or be formed by a track switch via which the vehicle can be moved from the guide track to a side track, which is particularly useful when people get on and off. But it is also useful for repairs to remove the respective vehicle from the guide track and couple it back in after the repair is completed. In both cases, the respective vehicle does not obstruct the guide track, and operation of the ride can continue.

The vehicles themselves typically do not have a drive mechanism of their own; instead, they are towed, for example by means of a sheathed cable, to an elevation at which their potential energy is sufficient for them to travel the remaining track without additional active acceleration. In such roller coasters, the course of the guide tracks is predetermined in that the highest point of the guide track follows directly after the start.

In the present case, the amusement ride and particularly the roller coaster comprises a launch section, which is to mean an acceleration path that is part of the guide track and within which the vehicles are accelerated by means of a drive mechanism to a speed at which the kinetic energy of the vehicles is sufficient for them to either travel the entire track or at least to the next launch section without additional active acceleration. Active acceleration is to mean acceleration by means of a drive mechanism. The acceleration of vehicles when going down slopes due to the downhill driving force which acts on the vehicles is not considered to be active acceleration.

Since the intention is to keep the launch section relatively short, the vehicles must be accelerated very rapidly, which contributes to the attractiveness of the respective amusement ride and particularly the respective roller coaster. To be able to provide such high accelerations, the launch sections in modern amusement rides comprise a linear induction motor or a linear synchronous motor, which operate like a rotating electric motor, but with the difference that the electric magnets are not arranged in a circle around a rotor but are arranged along the launch section. The vehicle comprises a guide bar which interacts with the electric magnets.

In another embodiment, the drive mechanism of the launch section may comprise hydraulic motors, wherein a hydraulic fluid is delivered via pumps into the reservoir. In other pressure vessels, nitrogen is highly compressed, which makes it possible to store the required energy relatively slowly and evenly. At the start, the compressed gas presses the hydraulic oil from the reservoir through pipes to the hydraulic motors which are arranged in a circle. The vehicles or caddies that can be coupled with the vehicle are pulled by means of a steel cable and accelerated in this manner.

In another embodiment, a pneumatic cylinder through which the cable runs as well extends next to the launch section. A slider in the pneumatic cylinder is fastened to the steel cable opposite the caddy. Due to the sudden increase in pressure on the one side of the slider, said slider is moved in the opposite direction and in this way drives the cable pull.

As disclosed, different riding experiences can be provided on the same amusement ride and particularly on the same roller coaster by using at least two vehicles which comprise two different person receiving arrangements. This is based on the finding that people on a ride perceive traveling on the same guide track differently if they are positioned and secured differently and have a different orientation towards the guide track. This creates the advantage for the operator of the amusement ride and particularly the roller coaster that at least two different riding experiences can be provided on the same roller coaster, which would otherwise only be possible with one or more additional complete roller coasters. Retrofitting existing roller coasters is also possible at relatively low investment cost. For this purpose, a new vehicle with a newly designed person receiving arrangement, which provides a driving experience previously not offered, can replace an old vehicle. There is no need for a completely new roller coaster. The first vehicle and the second vehicle can easily be coupled into the guide track by means of the in-coupling device without requiring a lot of time to do so. On the contrary, the people can get on and off the decoupled vehicles while the coupled vehicles travel along the guide track. A completely loaded vehicle will then be ready when the in-coupled vehicle ends its ride. This increases passenger throughput and allows a more efficient operation of the amusement ride or roller coaster, respectively.

In the case that the amusement ride has a first and a second vehicle which comprise two different person receiving arrangements, an individual must ride the amusement ride at least twice to experience both riding experiences at least once. This increases the attractiveness of the amusement ride and makes it more likely that the ride can be operated economically.

According to another embodiment, the first person receiving arrangement is row-shaped and the second person receiving arrangement is circular in design. A row-shaped person receiving arrangement should be understood as a person receiving arrangement where people are received in the vehicles in rows behind one another, as is typical of airplanes and center aisle coaches of trains. In a circular person receiving arrangement, people are either received facing a joint center or facing away from said center or tangentially to said center. Alternatively, the person receiving arrangement can be oval, elliptical, or polygonal.

Due to the different configuration of the person receiving arrangements, different riding experiences can be provided on one and the same roller coaster in a technologically simple manner and at low investment cost. It is not necessary to build one or more new roller coasters.

Another embodiment specifies that the second person receiving arrangement has at least one degree of freedom more or has a different degree of freedom with respect to mobility from the first person receiving arrangement, and vice versa. The second person receiving arrangement can for example have a rotatable, pivotable, or tillable configuration, while the first person receiving arrangement does not include this mobility. Alternatively, the degree of freedom can be the same for both person receiving arrangements but refer to a different space axis. For example, the first person receiving arrangement can be rotatable about a rotational axis extending perpendicular to the first vehicle while the second person receiving arrangement can be rotated about an axis extending parallel to the second vehicle. Again, another riding experience is implemented on the same guide track at relatively low investment cost.

In an embodiment developed further, the second person receiving arrangement can comprise a number of rotatably mounted plates or disks. In the person receiving arrangement with a circular configuration, it is useful to provide rotatably mounted plates with which individuals can be rotated about a rotational axis during the ride. In this way, another riding experience not offered on the other vehicle can be provided, which once again helps increase the attractiveness of the roller coaster.

In an embodiment developed further, the first person receiving arrangement may comprise a number of seats for seated accommodation of people and the second person receiving arrangement may comprise a number of personal safety posts for securing people who are standing, or vice versa. While it is common in most roller coasters to receive seated people, receiving people who are standing is rather an exception, But it is of considerable significance for the respective riding experience whether people are riding a roller coaster while sitting or standing. The respective riding experiences are dramatically different without requiring major technical modifications and thus a larger investment in the roller coaster.

According to an embodiment developed further, the first person receiving arrangement comprises a number of seats for seated accommodation of people and the second person receiving arrangement comprises a number of seats for seated accommodation of people, wherein the seats of the first person receiving arrangement have a different orientation from the seats of the second person receiving arrangement. For example, some seats can be oriented towards the front end of the respective vehicle while the other seats are oriented towards the rear end, which is not the case in the other vehicle. Orientation of some or all seats to the side ends of the respective vehicle, which is not the case in the other vehicle, is conceivable as well. Once again the respective riding experiences are dramatically different without requiring major technical modifications and thus a larger investment in the amusement ride.

In another embodiment, the in-coupled first and second vehicles can be breakable by means of the launch section. If the launch section has a linear induction motor or a linear synchronous motor, the launch section can be used for accelerating and for braking, and no separate braking mechanism is needed. This keeps investment costs low.

Another embodiment is characterized in that the launch section extends across a front and a rear end of the in-coupling device. The definition of the front end and rear end is to be based on the typically used direction of travel. Accordingly, the vehicles are accelerated via the front end of the in-coupling device. Since the launch section also extends across the rear end of the in-coupling device, vehicles can be braked and stopped before they reach the in-coupling device. This can on the one hand be advantageous for safety reasons, on the other hand it can be used to compensate delays in operation, for which the braked vehicle can wait before the in-coupling device until the device is released.

Since the launch section extends both across the front end and across the rear end of the in-coupling device, the path available for accelerating or braking lengthens. This makes it possible, for example, to move a vehicle first slowly backwards across the rear end of the in-coupling device to accelerate the respective vehicle thereafter over an accordingly lengthened path. This can be particularly useful when the respective vehicle is particularly heavy. The above applies accordingly to deceleration, such that a vehicle is braked when it travels through the front end of the in-coupling device and is slowly moved backwards into the in-coupling device after it has come to a standstill. This is a way to reduce the forces which act on the people during acceleration and deceleration.

An embodiment developed further is characterized in that the roller coaster includes detection means which can detect if a first vehicle or a second vehicle is coupled into the guide track. The launch section can only be activated if it is confirmed that a vehicle is coupled into the guide track. Depending on whether a first or a second vehicle is coupled into the guide track, it can be desirable or even necessary to accelerate the respective vehicle more or less rapidly. Depending on the configuration of the person receiving arrangement, the forces which act on the people may have to be limited, which can particularly be achieved by traveling along the guide track at a lower speed. In addition, the different configurations of the person receiving arrangements may result in a different weight of the respective vehicles, which can or must also be taken into account with respect to acceleration. The detection means make it possible to determine unambiguously which vehicle is currently coupled into the guide track. The detection means can be connected to a control unit on which the acceleration profile defined for the respective vehicle is stored, such that it is ensured that always the defined acceleration profile is used.

BRIEF DESCRIPTION OF THE DRAWINGS

An exemplary embodiment of the present application will be described with reference to the accompanying figures below. Wherein.

DETAILED DESCRIPTION

Figure 1:
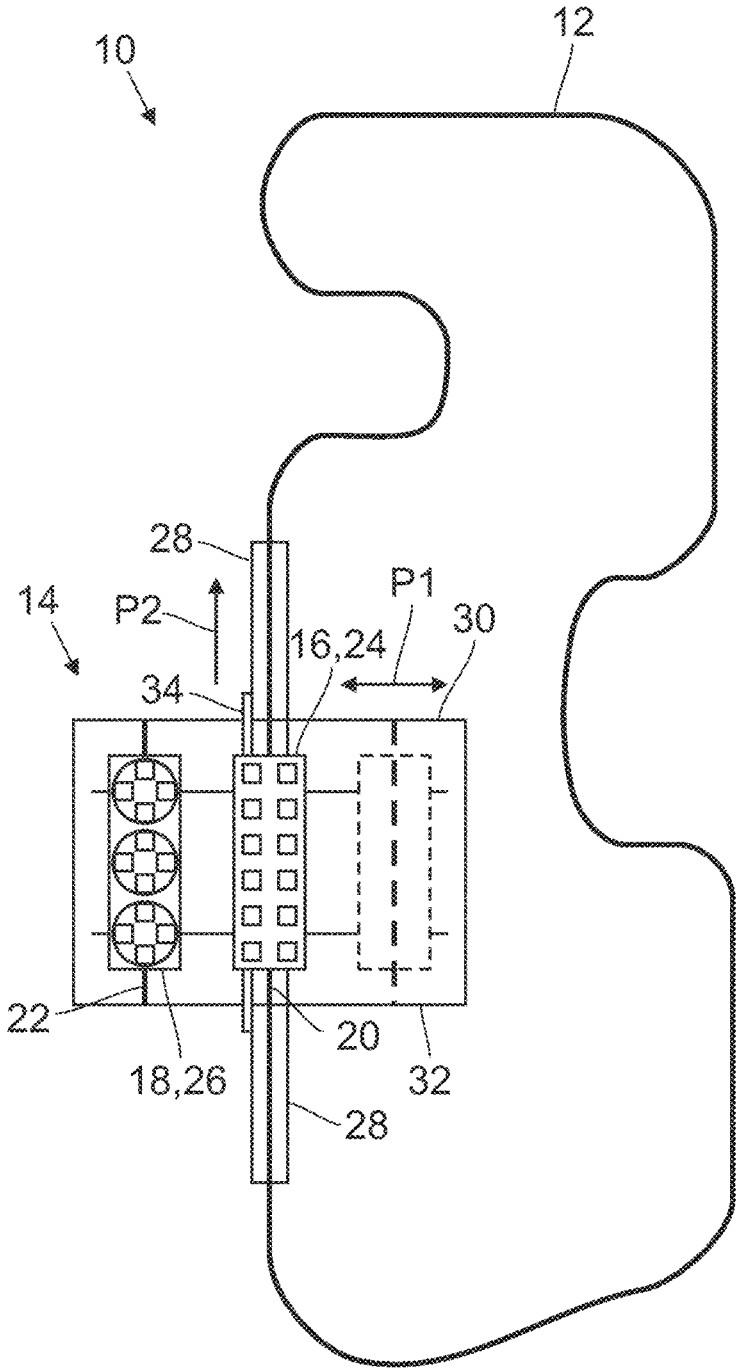
FIG. 1 shows a schematic top view of an embodiment of an amusement ride according to the present application which is configured as a roller coaster, FIG. 2*a*) shows a schematic top view of the first vehicle, FIG. 2*b*) shows a schematic side view of the first vehicle shown in FIG. 2*a*) with a first exemplary embodiment of a first person receiving arrangement, FIG. 2*c*) shows a schematic side view of the first vehicle shown in FIG. 2*a*) with a second exemplary embodiment of a first person receiving arrangement, and FIG. 2*d*) shows a schematic top view of a second vehicle.

FIG. 1 shows a schematic top view of an exemplary embodiment of an amusement ride 10 according to the present disclosure which is configured as a roller coaster 10. The roller coaster 10 includes a guide track 12, which defines a closed course and which includes a number of bends, ascents, descents, loops, and other direction-changing areas. An in-coupling device 14 can be used to couple a first vehicle 16 and a second vehicle 18 into the guide track 12. Withing the in-coupling device 14, the first vehicle 16 is on a first guide track section 20 and the second vehicle 18 is on a second guide track section 22. The first guide track section 20 and the second guide track section 22 can be moved inside the in-coupling device 14 along the directions indicated by the arrow P1 and can thus be introduced laterally into the remaining guide track 12. The first or the second vehicle 18 are then coupled into the guide track 12 when the first guide track section 20 or the second guide track section 22, respectively, is flush with the remaining guide track 12.

Instead of a linear movement, the in-coupling device 14 may also include track switches, particularly dropping and turning switches, to remove the first and second vehicles 16, 18 from the guide track or introduce them back into it.

Furthermore, the first vehicle 16 comprises a first person receiving arrangement 24 and the second vehicle 18 comprises a second person receiving arrangement 26, which differ from one another. This will be explained in greater detail below.

Furthermore, the roller coaster 10 includes a launch section 28, which extends both across a front end 30 of the in-coupling device 14 and across a rear end 32 of the in-coupling device 14. The definition of the front and rear ends 30, 32 of the in-coupling device 14 is based on the direction of travel into which the first and second vehicles 18 are typically moved, and which is shown by the arrow P2. The launch section 28 is used to accelerate the first vehicle 18 and the second vehicle 20, for which purpose the launch section 28 comprises a linear induction motor or a linear synchronous motor not shown in the figure. In the exemplary embodiment of the roller coaster 10 shown, the launch section 28 is also used for braking the first and second vehicles 18*s*, but this does not inevitably need to be the case.

The roller coaster 10 is operated as follows: Either the first vehicle 16 or the second vehicle 18 is coupled into the guide track 12 by means of the in-coupling device 14. Then the vehicle is accelerated by means of the launch section 28 to a speed at which the first vehicle 16 has a sufficiently high kinetic energy to be able to travel through the entire guide track 12 without any further active acceleration. Based on the position shown in FIG. 1, the first vehicle 16 can either be directly accelerated in the direction of travel via the front end 30 of the in-coupling device 14, or it can first slowly be moved backwards via the rear end 32 of the in-coupling device 14 and then be accelerated in the direction of travel by means of the front end 30.

While the accelerated first vehicle 16 is on the guide track 12 and outside the in-coupling device 14, the second vehicle 18 can be loaded and unloaded. In other words, the people can get off the second vehicle 18 after their ride is completed, and people still waiting for their ride can get into the second vehicle 18.

As soon as the first vehicle 16 has traveled through the guide track and reached the launch section 28 again, it is braked down by the section. Braking down can be performed such that the first vehicle 16 comes to a stop directly in the position shown in FIG. 1 without having crossed the front end 30 of the in-coupling device 14. Alternatively, the braking operation can be performed such that the first vehicle 16 only comes to a stop after having crossed the front end 30, but is still within the launch section 28. The first vehicle 16 is then slowly moved backwards until it has reached the position shown in FIG. 1. Then the first guide track section 20 and thus the first vehicle 16 are moved inside the in-coupling device 14 to the right relative to the representation in FIG. 1 and consequently decoupled from the guide track 12, which is indicated by the dashed lines. At the same time or with a short delay, the second guide track section 22 with the second vehicle 18 are also moved to the right inside the in-coupling device 14 until the second guide track section 22 is flush with the rest of the guide track 12. Then the second vehicle 18 is moved along the guide track 12 in the same manner as described for the first vehicle 16.

While the second vehicle 18 is on the guide track 12 and outside the in-coupling device 14, people can get off the first vehicle 16 and waiting people can get on the first vehicle 16.

The roller coaster 10 further includes detection means 34 which can be used to determine that one of the vehicles 16, 18 is coupled into the guide track 12 and that therefore the launch section 28 can be activated. The detection means 34 can also detect if the first vehicle 18 or the second vehicle 20 is coupled into the guide track 12. The acceleration and braking processes can thus be adjusted to the in-coupled vehicle 18, 20.

Figure 2A:
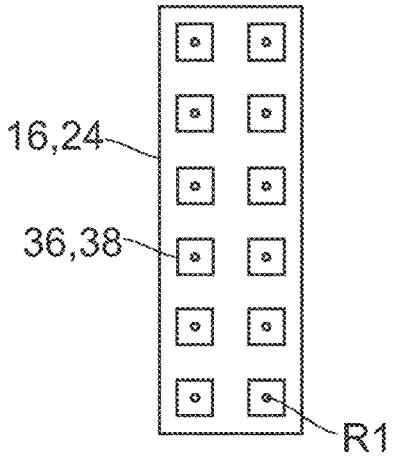

FIG. 2*a*) shows a schematic top view of a first exemplary embodiment of the first vehicle 16. The first vehicle 16 comprises a first person receiving arrangement 24, which is configured in rows. The first person receiving arrangement 24 may comprise a number of seats 36 or personal safety posts 38, which are also shown in schematic side views in FIGS. 2*b*) and 2*c*), respectively. While the seats 36 are used for seated transport of people, the people can be transported in standing position by means of the personal safety posts 38. The seats 36 and personal safety posts 38 are mounted for rotation about a first rotational axis R1 which is perpendicular to the guide track 12 in order to rotate these elements accordingly during the ride.

The personal safety posts 38 each include a standing section 40 onto which a passenger must step. This standing section 40 may include fastening means not shown, by means of which a passenger can be secured in the leg region during the ride. The entire standing section 40 can be rotated with the other personal safety posts 38 about said first rotational axis R1 during the ride.

Both the seats 36 and the personal safety posts 38 comprise bracket-like retention means 42 by means of which the passengers can be secured in their upper body region during the ride.

Figure 2B:
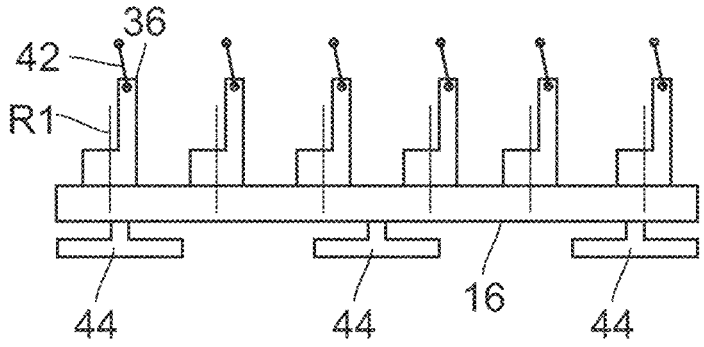
Figure 2C:
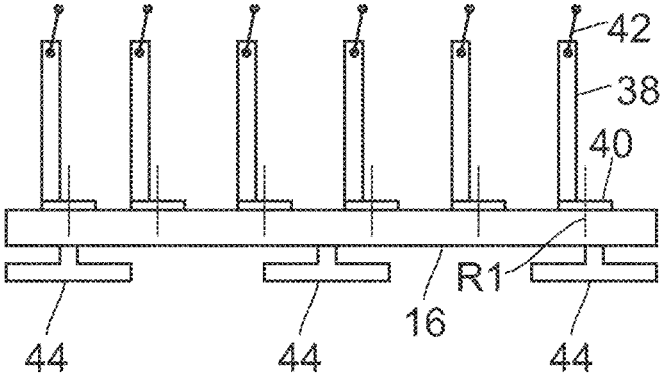

It is visible in FIGS. 2*b*) and 2*c*) that the first vehicle 16 comprises a number of rolling devices 44 by means of which the first vehicle 16 is secured to the guide track 12 and can roll along the guide track 12.

Figure 2D:
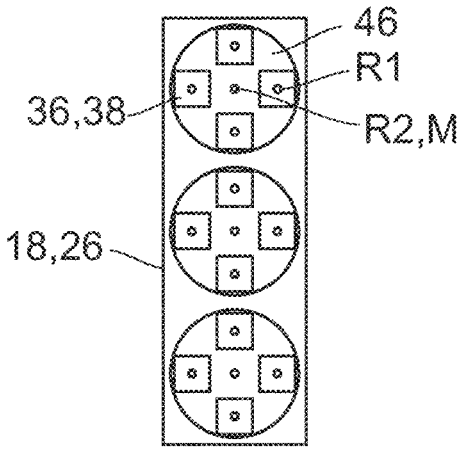

FIG. 2*d*) shows a first exemplary embodiment of a second vehicle 18 with a second person receiving arrangement 26, also in a schematic top view. Unlike the first person receiving arrangement 24 of the first vehicle 16, the second person receiving arrangement 26 has a circular configuration, such that the seats 36 or personal safety posts 38 are facing towards or away from a center point M. The seats 36 and the personal safety posts 38 may also be oriented tangentially to the center point M. In addition, the second person receiving arrangement 26 includes a number of disk-like plates 46, in this example three plates 46, on each of which four seats 36 or personal safety posts 38 are arranged, which match those shown in FIGS. 2*b*) and 2*c*). The plates 46 are also mounted for rotation about a second rotational axis R2 which also runs perpendicular to the guide track 12, such that the seats 36 or the personal safety posts 38 can be rotated together with the plates 46 about the second rotational axis R2 during the ride. In addition, the seats 36 or the personal safety posts 38 can also be rotatable about the first rotational axis R1, like the first person receiving arrangement 24.

Like the first vehicle 16, the second vehicle 18 comprises the identical rolling devices 44, not visible in FIG. 2*d*), by means of which the second vehicle 18 is secured to the guide track 12 and on which it can roll along the guide track 12.

It should be noted here that the vehicles 16, 18, which differ only in the number of seats 36 or personal safety posts 38, have the same person receiving arrangement 24, 26. In addition, multiple first and second vehicles 16, 18 can be coupled into the guide track 12, wherein typically only one vehicle 16, 18 at a given point in time is coupled into the guide track 12 for safety reasons. If the riding time is relatively short compared to the time for gelling on/off, multiple vehicles 16, 18 can be loaded and unloaded while one of the vehicles 16, 18 is coupled into the guide track 12.

If the guide track 12 is sufficiently long and the roller coaster 10 has respective safety means, multiple vehicles 16, 18 can be coupled into the guide track 12 at the same time. Furthermore, the roller coaster 10 may comprise other vehicles in addition to the first and the second vehicle 16, 18, which comprise person receiving arrangements that differ from the first and second person receiving arrangements 24, 26.

LIST OF REFERENCE SYMBOLS

10 Amusement ride, roller coaster
12 Guide track
14 in-coupling device
16 First vehicle
18 Second vehicle
20 First guide track section
22 Second guide track section
24 First person receiving arrangement
26 Second person receiving arrangement
28 Launch section
30 Front end
32 Rear end
34 Detection means
36 Seat
38 Personal safety post
40 Standing section
42 Retention means
44 Rolling device
46 Plates
M Center point
P1 Arrow
P2 Arrow
R1 First rotational axis
R2 Second rotational axis

The invention claimed is:

1. An amusement ride, comprising:

a guide track, a first vehicle that moves along the guide track and has a first person receiving arrangement, a second vehicle that moves along the guide track and has a second person receiving arrangement which differs from the first person receiving arrangement, an in-coupling device that couples the first vehicle and the second vehicle into the guide track, wherein the first vehicle, the second vehicle, or a combination thereof, are configured to be removed from the guide track by utilizing the in-coupling device and re-coupled into the guide track after being removed from the guide track, and a launch section that accelerates the first vehicle, the second vehicle, or a combination thereof, that are coupled to the guide track.

2. The amusement ride according to claim 1, wherein the first person receiving arrangement is configured in rows and the second person receiving arrangement is configured in of a circle.

3. The amusement ride according to claim 1, wherein the second person receiving arrangement has at least one degree of freedom more or has a different degree of freedom with respect to mobility from the first person receiving arrangement.

4. The amusement ride according to claim 1, wherein the second person receiving arrangement comprises a number of rotatably mounted plates.

5. The amusement ride according to claim 1, wherein the first person receiving arrangement comprises a number of seats for seated accommodation of people and the second person receiving arrangement comprises a number of personal safety posts for securing people who are standing.

6. The amusement ride according to claim 5, wherein the seats, the personal safety posts, or both the seats and personal safety posts, are rotatably mounted.

7. The amusement ride according to claim 1, wherein the first person receiving arrangement comprises a number of seats for seated accommodation of people and the second person receiving arrangement comprises a number of seats for seated accommodation of people, wherein the seats of the first person receiving arrangement have a different orientation from the seats of the second person receiving arrangement.

8. The amusement ride according to claim 1, wherein the first and second vehicles are configured to be braked by utilizing the launch section.

9. The amusement ride according to claim 1, wherein the launch section extends across a front end and a rear end of the in-coupling device.

10. The amusement ride according to claim 1, wherein the amusement ride detects whether the first vehicle, the second vehicle, or a combination thereof, is coupled into the guide track.

11. The amusement ride according to claim 1, wherein the first person receiving arrangement has at least one degree of freedom more or has a different degree of freedom with respect to mobility from the second person receiving arrangement.

12. The amusement ride according to claim 1, wherein the second person receiving arrangement comprises a number of seats for seated accommodation of people and the first person receiving arrangement comprises a number of personal safety posts for securing people who are standing.

13. A system, comprising:

a first vehicle that moves along an amusement ride guide track and has a first person receiving arrangement with a first person receiving arrangement degree of freedom;

a second vehicle that moves along the amusement ride guide track and has a second person receiving arrangement with a second person receiving arrangement degree of freedom;

an in-coupling device that couples the first vehicle and the second vehicle into the amusement ride guide track, wherein the first vehicle, the second vehicle, or a combination thereof, are configured to be removed from the guide track by utilizing the in-coupling device and re-coupled into the guide track after being removed from the guide track;

wherein the first person receiving arrangement differs from the second person receiving arrangement; and wherein the first person receiving arrangement degree of freedom differs from the second person receiving arrangement degree of freedom.

14. The system of claim 13, further comprising a launch section that accelerates the first vehicle and the second vehicle coupled into the guide track along the amusement ride guide track.

15. The system of claim 13, wherein the first person receiving arrangement is configured in rows and the second person receiving arrangement is configured in a circle.

16. The system of claim 13, wherein the second person receiving arrangement degree of freedom includes rotational freedom.

17. The system of claim 13, wherein the first person receiving arrangement comprises a plurality of rider seats;

wherein the second person receiving arrangement comprises a plurality of standing rider safety posts;

wherein a rider seat of the plurality of rider seats orientates a seated rider in a first orientation with respect to the amusement ride guide track;

wherein a standing rider safety post of the plurality of standing rider safety posts orientates a standing rider in a second orientation with respect to the amusement ride guide track; and wherein the first orientation is different than the second orientation.

* * * * *